US005536552A

United States Patent [19]

Scripsick

[11] Patent Number: 5,536,552

[45] Date of Patent: Jul. 16, 1996

[54] PLANK FOR A BENCH OR THE LIKE

[75] Inventor: Ronald L. Scripsick, Pittsburg, Kans.

[73] Assignee: Poli-Tron, Inc., Pittsburg, Kans.

[21] Appl. No.: 287,245

[22] Filed: Aug. 8, 1994

[51] Int. Cl.[6] ..... B32B 7/00

[52] U.S. Cl. ..... 428/98; 52/405.3; 297/158.3; 428/99; 428/119; 428/120; 428/131; 428/138; 428/457

[58] Field of Search ..... 428/98, 99, 119, 428/120, 131, 138, 457; 52/405.3; 297/157; 108/111

[56] References Cited

U.S. PATENT DOCUMENTS

| | | | |
|---|---|---|---|
| 2,670,031 | 2/1954 | Melges | 280/43.1 |
| 2,805,708 | 9/1957 | Bohn | 297/157 |
| 2,831,688 | 4/1958 | Knox | 428/119 |
| 3,353,867 | 11/1967 | Anderson | 297/228.13 |
| 3,765,719 | 10/1973 | Silver | 297/170 |
| 3,905,478 | 9/1975 | Peterson | 428/119 |
| 4,740,032 | 4/1988 | Olsen et al. | 297/157 |
| 4,834,450 | 5/1989 | Stickler | 297/157 |
| 4,998,395 | 3/1991 | Bezner | 428/119 |
| 5,070,664 | 12/1991 | Groh et al. | 52/177 |

*Primary Examiner*—Nasser Ahmad
*Attorney, Agent, or Firm*—Hovey, Williams, Timmons & Collins

[57] ABSTRACT

A plank for loading surfaces of a picnic bench, bleacher, boat dock and the like including an elongated element formed of a synthetic resin, a plurality of elongated reinforcing bars, and structure provided for connecting the reinforcing bars to the synthetic resin element. The synthetic resin element is formed with a substantially flat web defining a load surface and an undersurface, a pair of side walls extending normally from the undersurface along the length of the element, a plurality of internal walls inward of and parallel to the side walls, and structure for restraining twisting of the reinforcing bars about their longitudinal axis during loading of the plank. The reinforcing bars support the synthetic resin element and restrict bending along the length of the element.

8 Claims, 2 Drawing Sheets

PLANK FOR A BENCH OR THE LIKE

BACKGROUND OF THE INVENTION

1. Field of the Invention

The present invention relates generally to a plank which in a single horizontal orientation forms a loading surface of a picnic bench, bleacher, boat dock and the like and, more particularly, to a plank with a primary structural element and load surface formed of a synthetic resin and a number of reinforcing bars preferably formed of a metal.

2. Discussion of Prior Art

It is known to provide wooden or metal planks for benches and the like with a thermoplastic cap or sheathing for enhancing the planks weatherability and life span. In this apparatus the wood or metal plank is the structural member and the thermoplastic cap or sheathing is merely a weather protectant and load surface cover—similar to a protective coating such as paint.

Conventionally, planks not employing thermoplastic covers use a wood stringer or metal beam that is treated or coated. Typically, wood stringers are constructed of a treated wood or coated with a protective paint. Metal beams are usually constructed of a non-corrosive metal such as aluminum, or a steel which is galvanized, plated, or painted with a rust inhibiting coating.

These initial plank constructions have the following shortcomings. Wood stringers are often characterized as having short lives with high maintenance costs. Wood stringers coated with paint often cause peeling, cracking, and ultimately destruction of the coatings due to exchange of moisture to and from the stringer. Treated wood contains chemicals which could be transferred to an individual by a splinter sometimes causing severe irritation.

Metal planks have also proven to be inadequate. A metal plank may not be quite as short-lived as a wood plank but is substantially more expensive and conducts heat away from the body. Aluminum, the most expensive metal alternative, tends to become burred after use and stains clothing if not properly anodized. Galvanized or plated steel often requires finishing to remove sharp excess coating material and additional machining. Painted steel requires regular maintenance or the beam rusts and poses a serious health risk (i.e. tetanus) to people using the plank. All of the above-mentioned plank materials demand some form of maintenance and, more importantly, most eventually require replacement at a considerable cost.

Thermoplastic covers are utilized to provide a safe, comfortable load surface and overcome the poor weatherability of wood stringers and metal beams, thus reducing the maintenance and replacement costs. By shielding surfaces exposed to sunlight and rain, the beam or stringer experiences only the detriments caused by changing temperature and humidity of the ambient air. Additionally, by covering the stringer or beam with a thermoplastic cover typical loading surface preparation, such as sanding, is eliminated. Improvements have also been made to the thermoplastic materials used in production and designs of the caps or sheathing. For example, designs of covers for wooden stringers have been modified to leave the undersurface exposed so the wood could "breathe" and adjust to ambient humidity changes.

Although the thermoplastic caps or sheathing represent an improvement over other conventional planks for a picnic bench and the like, there is a need to provide an improved plank which entirely eliminates costly wood stringers and metal beams. The use of a thermoplastic cover may reduce replacement and maintenance costs of planks, however, there is no diminution of initial construction costs. Clearly, initial costs are higher with the thermoplastic covers. Furthermore, utilizing thermoplastic covers only delays the replacement of the wooden stringers or metal beams and the considerable costs associated therewith.

OBJECTS AND SUMMARY OF THE INVENTION

Thus, it is an object of the present invention to provide a plank used in a picnic bench and the like which employs a unitary synthetic resin structural element and a number of reinforcing bars eliminating the need for the short-lived and expensive wood stringers and metal beams of conventional planks.

It is a further important object of the present invention to provide a plank which is capable of supporting loads associated with a picnic bench and the like. Additionally, the present plank must provide a smooth and comfortable loading surface.

Another object of the present invention is to provide a unitary synthetic resin structural element and reinforcing bars that are simple and inexpensive to fabricate and install such that little or none of the fabrication costs, installation costs, maintenance costs, and replacement costs associated with thermoplastic covered wood stringers and metal beams are realized.

In accordance with these and other objects evident from the following description of a preferred embodiment of the invention, the plank includes an elongated element formed of a synthetic resin, a plurality of elongated reinforcing bars, and structure provided for connecting the reinforcing bars to the synthetic resin element. The synthetic resin element is formed with a substantially flat load web defining a load surface and an undersurface, a pair of side walls extending normally from the undersurface along the length of the element, a plurality of internal walls inward of and parallel to the side walls, and structure for restraining twisting of the reinforcing bars about their longitudinal axis during loading of the plank. The reinforcing bars support the synthetic resin element and restrict bending along the length of the element.

By providing a plank in accordance with the present invention, numerous advantages are realized. For example, by utilizing a synthetic resin, the elongated element can be easily and inexpensively manufactured. Additionally, synthetic resins can have perpetual lives in even the most extreme weather conditions. Another advantage of the present invention is that a unitary synthetic resin element which defines both the load surface and the primary structural member provides cushion and flexion during use. Furthermore, synthetic resin materials can be selected that resist rotting, warping, chipping, splintering, staining, impact loading, and Ultraviolet degradation. Synthetic resin materials can also be selected which require no finishing and can be easily cleaned.

Further, by providing a plank in accordance with the present invention, the reinforcing bars demand little material and can be designed for inexpensive and simple manufacture. The reinforcing bars are covered by the synthetic resin element so that the bars experience minimal weather effects. Additionally, a reinforcing bar material can be chosen which is virtually insusceptible to weather conditions such that there are little or no replacement costs of the claimed plank.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 2:
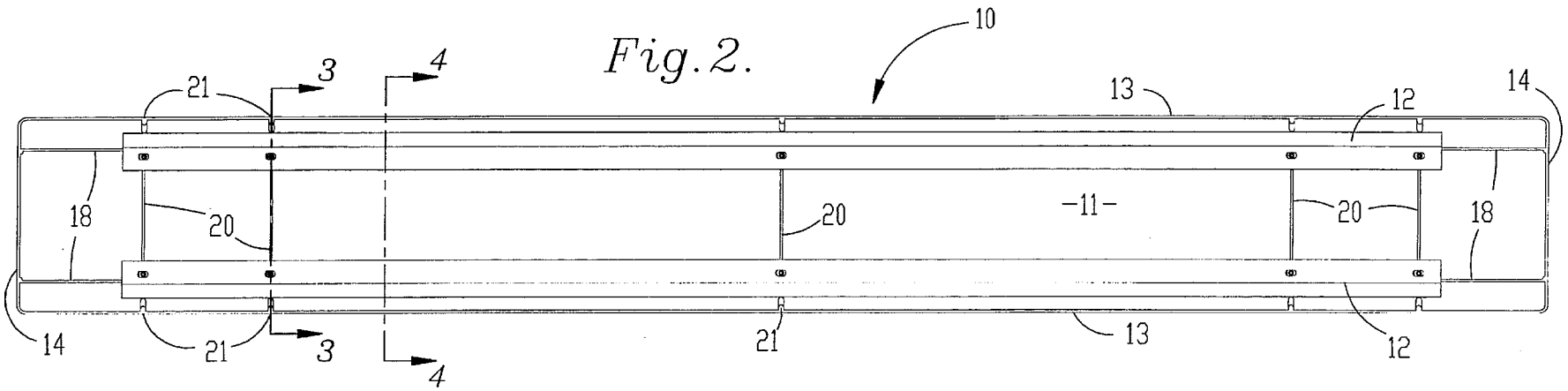
FIG. 2 is a bottom plan view of the plank.

As best shown in FIG. 2, the preferred embodiment contemplates a plank, generally designated 10, for loading surfaces of a picnic bench and the like. In general, the preferred embodiment makes use of an elongated unitary synthetic resin element 11 and a pair of elongated reinforcing bars 12. When desired more than two reinforcing bars 12 can be used.

Figure 4:
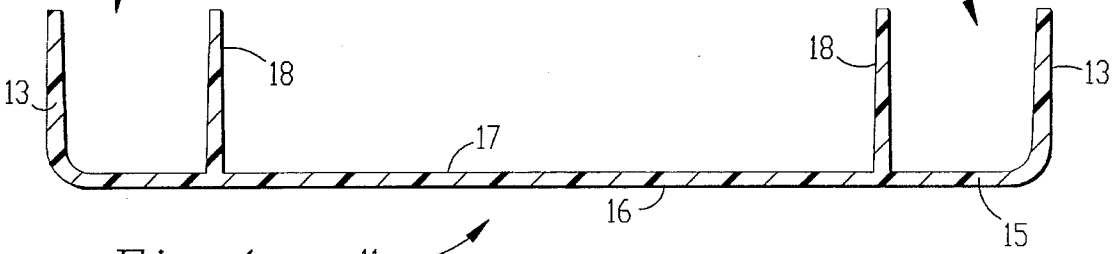
FIG. 4 is a vertical sectional view taken along line 4—4 of FIG. 2, illustrating the synthetic resin element with the reinforcing bars removed.

In more detail, the synthetic resin element 11 includes a pair of side walls 13 that extend along the length of the element 11 and a pair of end walls 14 transverse to the side walls 13. As shown in FIG. 4, the side walls 13 and end walls 14 extend normal to the periphery of a substantially flat load web 15. The load web 15 defines a load surface 16 and an undersurface 17 of the element 11.

Figure 3:
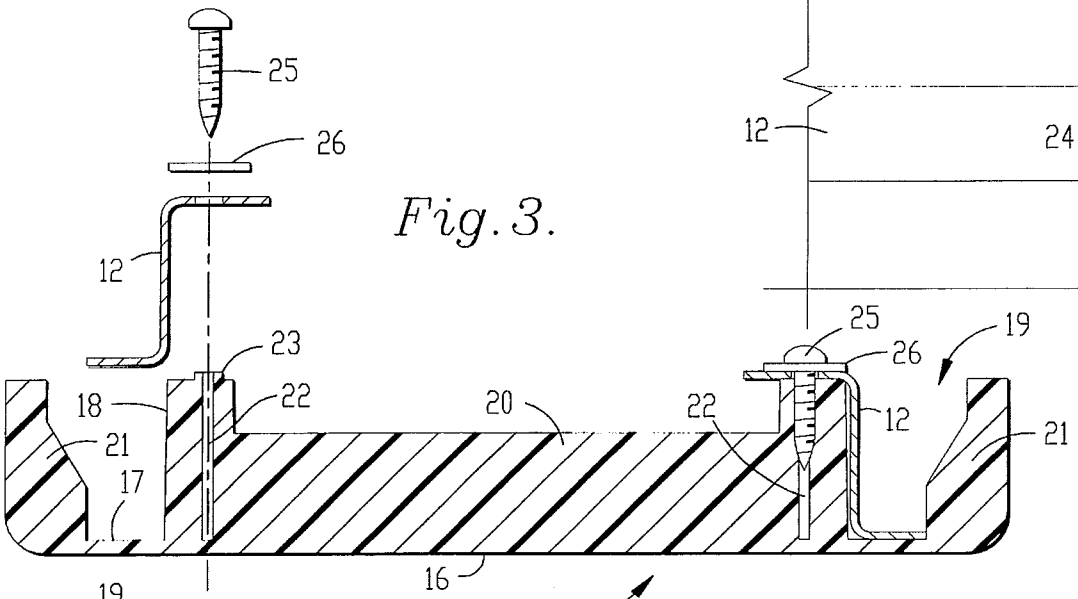
FIG. 3 is a vertical sectional view taken along line 3—3 of FIG. 2, illustrating the manner of connecting the synthetic resin element to a pair of reinforcing bars.

The preferred synthetic resin element 11 also includes structural members extending from the undersurface 17 of the load web 15 and located inward of the side walls 13 and end walls 14. As indicated in FIG. 2, a set of internal walls 18 extend along the length of the element 11, are spaced parallel to the side walls 13, and terminate at the end walls 14. As best shown in FIG. 4, a slot 19 is defined by each of the side walls 13 and the adjacent internal wall 18. As best shown in FIG. 3, a plurality of transverse gussets 20 interconnect the internal walls 18 and terminate at the internal walls 18 adjacent the side walls 13. The element also includes a plurality of tabs 21 depending from the side walls 13 and extending into the slots 19. A pair of tabs 21 are longitudinally aligned with each gusset 20. A screw hole 22 is formed at each joint of the internal walls 18 and a gusset 20. At the periphery of each screw hole inlet is an upstanding annular bushing 23.

Figure 1:
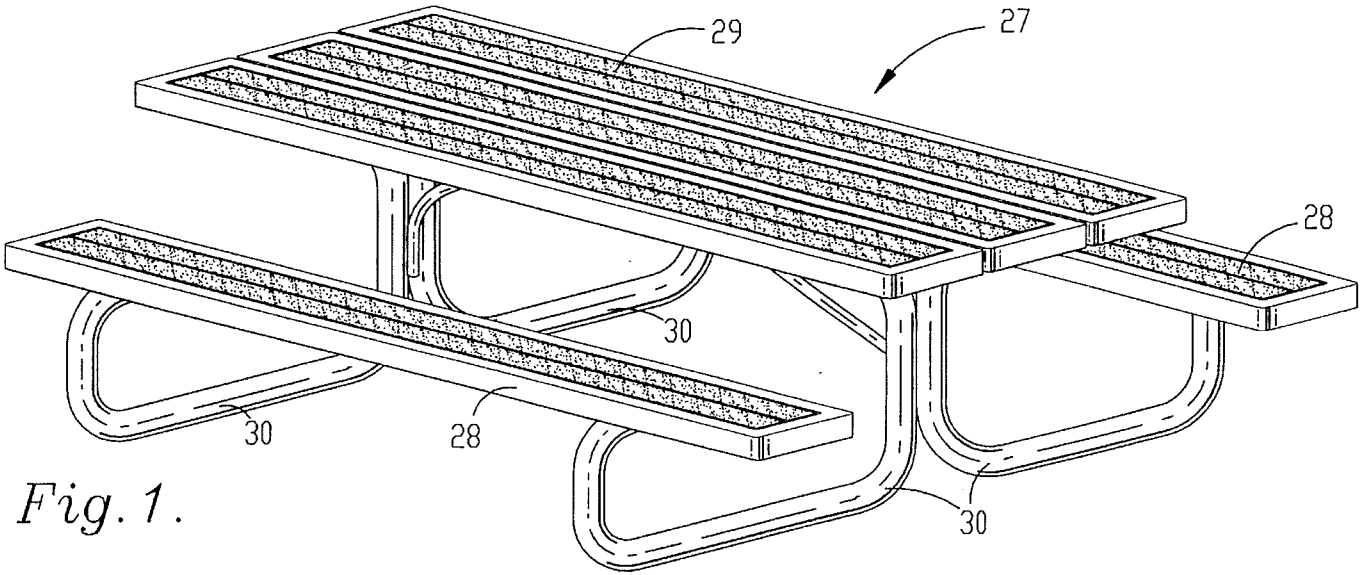
FIG. 1 is a perspective view of a picnic table utilizing a plank constructed in accord with the preferred embodiment.

Preferably the unitary synthetic resin element 11 is formed, using conventional methods, of a resinous polypropylene although polyethylene or ABS can be substituted. Additionally the load surface 16 can be textured, as illustrated in FIG. 1, providing aesthetics and a non-slip surface.

Figure 6:
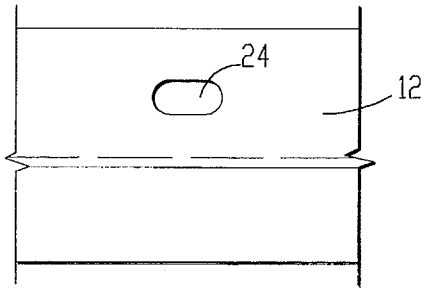
FIG. 6 is a fragmentary bottom plan view of a reinforcing bar at the location of a slotted hole.

As best shown in FIG. 3 the reinforcing bars 12 can be formed into a Z-shaped channel adapted to be received within the slots 19. The Z-shaped reinforcing bars 12 have a vertical central web and two horizontally opposed flanges. As best shown in FIG. 6, one of the opposed flanges of the Z-shaped reinforcing bars 12 includes a plurality of elliptical-shaped slotted holes 24. The slotted holes 24 are punched or machined such that the bushings 23 of the synthetic resin element 11 are received therein.

Preferably the Z-shaped reinforcing bars 12 are fabricated from a 14 Gauge workable steel. Although other shaped reinforcing bars can be utilized, the Z-shaped reinforcing bars 12 are preferred because of their simple fabrication and mating relationship with the preferred design of the element 11. Additionally, where it is desired the reinforcing bars 12 can be formed of a length running the entire length of the element 11.

As best shown in FIG. 3, the Z-shaped reinforcing bars 12 are connected to the preferred synthetic resin element 11. A reinforcing bar 12 is vertically received within each of the slots 19 of the element 11. As illustrated, the reinforcing bars 12 are formed such that the non-slotted flange seats against the undersurface 17 and butts against the tabs 21, the web is supported by the adjacent internal wall 18, and the slotted flange extends tangentially from the adjacent internal wall 18. The tabs 21 restrict transverse movement of the reinforcing bars 12 within the slots 19.

Figure 5:
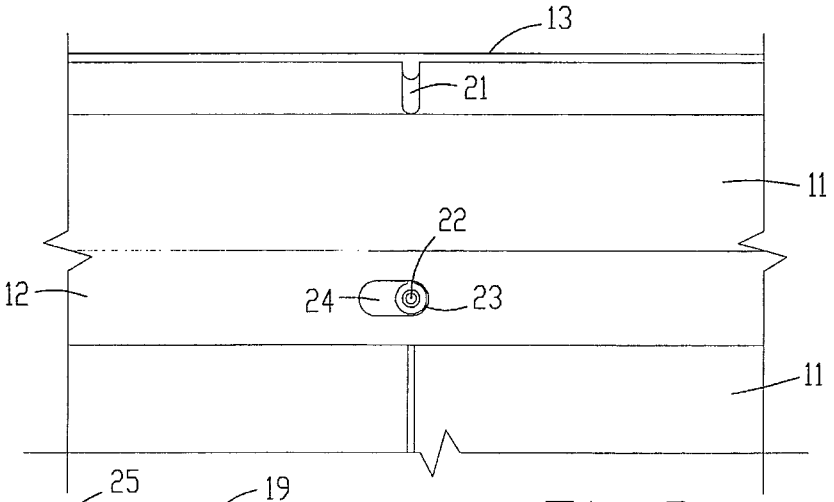
FIG. 5 is a fragmentary bottom plan view of a reinforcing bar and the synthetic resin element, illustrating the preferred manner of connecting the two.

As indicated in FIG. 5, each of the bushings 23 are aligned with and received in an associated slotted hole 24. It is known that synthetic resins and metals have different expansion rates. In order to prevent cracking and degradation at connection locations, the configuration of the preferred embodiment permits the metal reinforcing bars 12 to be secured to the synthetic resin element 11 while providing for relative expansion between the two. This is accomplished by the configuration of the bushing 23 and elliptical slotted hole 24, wherein each bushing 23 is shiftable within each slotted hole 24.

The reinforcing bars 12 are secured to the synthetic resin element 11 at a plurality of fastening sites. The fastening sites are located at each bushing 23 and slotted hole 24 association. As shown FIG. 3, once each of the bushings 23 is received within an associated slotted hole 24, the reinforcing bars 12 are secured to the element 11 using conventional wood screws 25 or the like, which are received within the screw holes 22. A flat washer 26 can be utilized as a bearing surface for the screw and is necessary if a wood screw is used with a head smaller than the inner boundary of the slotted hole 24.

When the plank 10 is loaded in a direction normal to the load surface 16 the force exerted thereon is transferred to the reinforcing bars 12 in a manner tending to twist the bars. As will be apparent below, the Z-shaped reinforcing bars 12 and the synthetic resin element 11 have a reciprocal relationship—the bars 12 support the element 11 along the length thereof, and structure of the element 11 restrains twisting of the bars. As best shown in FIG. 3, with the reinforcing bar 12 illustrated as connected to the element 11, the bar is restrained from twisting counter-clockwise by butting against the tabs 21 and by structure of each fastening site. When the reinforcing bar 12 is biased in a counter-clockwise direction the non-slotted flange abutingly engages the tabs 21 and further twisting is restricted. Additionally, the bushing 23 received within the slotted hole 24 and secured thereto by the screw 25 further resists twisting of the reinforcing bars 12.

Twisting of the reinforcing bar 12 in the clockwise direction is restrained by the adjacent internal wall 18, by seating against the undersurface 17, and by the structure of each fastening site. Obviously, the non-slotted flange of the reinforcing bar 12 seating against the undersurface 17 will resist clockwise twisting. The structure of each fastening site, similar to counter-clockwise twisting, further restrains clockwise twisting. Additionally, the internal wall 18 prevents the central web of the reinforcing bar 12 from clockwise twisting. Note, the connected reinforcing bar 12 is depicted as not contacting the internal wall 18. This is due to the radius often associated with angles formed on a break press. However, minimal twisting of the reinforcing bar 12 is required before the bar contacts the internal wall 18 and further clockwise twisting is prevented. Furthermore, the gussets 20 counteract any force exerted on the internal wall 18 by the twisting bar 12.

This configuration and consequential torsional restraint of the reinforcing bars 12 greatly enhances the strength of the plank 10 both in the longitudinal and transverse direction. Because the previously described structure of the plank 10 resists bending along the length and width thereof, it can be attached to conventional picnic bench supports and the like without additional support structure. The inner walls 18 and side walls 13 which extend along the length of the synthetic resin element 11 and are normal to the load surface 16 also resist bending along the length of the plank 10. The gussets 20 and end walls 14 which are normal to the load surface 16 further resist bending along the width of the plank 10.

As shown in FIG. 1, the present invention can be used as loading surfaces for a picnic bench, generally designated 27. The plank can be used for both the bench seats 28 and the table top 29. The plank can also be employed as a bleacher, loading surface of a boat dock and the like. As apparent from above, field construction is quick and easy. The plank is attached to supporting members such as the picnic bench legs 30 using the screw holes 22 formed in the synthetic resin element 11 and an elongated screw 25. The screw is long enough to extend through the reinforcing bar 12 and the legs 30 and have threads remaining to engage the screw hole 22. Thus, the screw 25 attaches the plank 10 to the legs 30 and secures the reinforcing bars 12 to the synthetic resin element 11.

Although the invention has been described with reference to the preferred embodiment illustrated in the attached drawing figures, it is understood that substitutions may be made and equivalents employed herein without departing from the scope of the invention as recited in the claims.

What is claimed is:

1. A plank comprising:

an elongated unitary structural element formed of a synthetic resin material and including a substantially flat load web defining a load surface and an undersurface, a pair of side walls extending normally from said undersurface along the length of the element, and a plurality of internal walls extending normally from said undersurface and spaced laterally inward of and parallel to said side walls;

a plurality of elongated metal reinforcing bars each defining a longitudinal axis; and a connecting means connecting said reinforcing bars to said element adjacent said internal walls, said element including a restraining means for restraining said reinforcing bars from twisting about the longitudinal axis during loading of said plank in a direction normal to said load surface, said reinforcing bars supporting said element and restricting bending of said element along the length thereof.

2. An apparatus as recited in claim 1 wherein the element includes a pair of end walls extending normally from the undersurface of the load web along the width of said element and interconnecting said side walls.

3. A plank as recited in claim 1 wherein the reinforcing bars extend the length of said element.

4. A plank comprising:

an elongated unitary structural element formed of a synthetic resin material and including a substantially flat load web defining a load surface and an undersurface, a pair of side walls extending normally from said undersurface along the length of the element, and a plurality of internal walls extending normally from said undersurface and spaced laterally inward of and parallel to said side walls;

a plurality of elongated reinforcing bars each defining a longitudinal axis; and a connecting means connecting said reinforcing bars to said element adjacent said internal walls, said element including a restraining means for restraining said reinforcing bars from twisting about the longitudinal axis during loading of said plank in a direction normal to said load surface, said reinforcing bars supporting said element and restricting bending of said element along the length thereof, said connecting means including a plurality of screws, a plurality of screw holes adjacent said internal walls for receiving said screws, a plurality of raised annular bushings at said screw holes, and a plurality of elliptical slotted holes in said reinforcing bar in alignment with the screw holes, each of said bushings received in an associated elliptical slotted hole of said reinforcing bars allowing for relative axial shifting between said element and said reinforcing bars.

5. A plank as recited in claim 1 wherein two slots for receiving two of said reinforcing bars are defined by each of the side walls and an adjacent internal wall.

6. A plank as recited in claim 5 wherein the restraining means includes a plurality of transverse gussets interconnecting said internal walls, and a plurality of tabs each extending normally from one of said side walls into one of said slots at a position longitudinally aligned with one of said gussets, said tabs restricting transverse movement of said reinforcing bars within said slots, each of said reinforcing bars butting against the tabs extending from one of said side walls and being supported by the adjacent internal wall restraining twisting about the longitudinal axis during loading of said plank in a direction normal to said load surface when each of said reinforcing bars are received within one of said slots.

7. A plank comprising:

an elongated unitary structural element formed of a synthetic resin material and including a substantially flat load web defining a load surface and an undersurface, a pair of side walls extending normally from said undersurface along the length of the element, and a plurality of internal walls extending normally from said undersurface and spaced laterally inward of and parallel to said side walls;

a plurality of elongated reinforcing bars each defining a longitudinal axis; and a connecting means connecting said reinforcing bars to said element adjacent said internal walls, said element including a restraining means for restraining said reinforcing bars from twisting about the longitudinal axis during loading of said plank in a direction normal to said load surface, said reinforcing bars supporting said element and restricting bending of said element along the length thereof, said side walls and adjacent internal walls defining a pair of slots, each of said slots receiving one of said reinforcing bars.

said restraining means including a plurality of transverse gussets interconnecting said internal walls, and a plurality of tabs each extending normally from one of said side walls into one of said slots at a position longitudinally aligned with one of said gussets, said tabs restricting transverse movement of said reinforcing bars within said slots, each of said reinforcing bars butting against the tabs extending from one of said side walls and being supported by the adjacent internal wall restraining twisting about the longitudinal axis during loading of said plank in a direction normal to said load surface when each of said reinforcing bars are received within one of said slots, said reinforcing bars each being configured as a Z-shaped beam including a central web and a pair of opposed flanges.

8. A plank as recited in claim 7 wherein one of the Z-shaped reinforcing bars is vertically received within each of the two slots, one of said flanges seating against said undersurface and butting against the tabs extending from one of said side walls, the adjacent internal wall supporting said central web, and the other of said flanges extending tangentially from said internal wall.

* * * * *